US005111941A

United States Patent [19]

Hillestad

[11] Patent Number: 5,111,941

[45] Date of Patent: May 12, 1992

[54] SELF LOCKING FOLDER HANGER STRUCTURE

[76] Inventor: Jerome Hillestad, 1861 Viking Blvd., Cedar, Minn. 55011

[21] Appl. No.: 712,574

[22] Filed: Jun. 10, 1991

[51] Int. Cl.[5] ..... A47F 7/00

[52] U.S. Cl. ..... 211/46; 211/181; 312/184

[58] Field of Search ..... 211/189, 181, 45, 46, 211/11; 312/184

[56] References Cited

U.S. PATENT DOCUMENTS

| | | | |
|---|---|---|---|
| 2,241,084 | 5/1941 | Dobbins | 211/45 X |
| 3,848,748 | 11/1974 | Ceccarelli | 211/46 X |
| 3,860,119 | 1/1975 | Irvine et al. | 211/45 |
| 3,999,663 | 12/1976 | Walter et al. | 211/46 X |
| 4,295,571 | 10/1981 | Meyer | 211/45 X |
| 4,901,867 | 2/1990 | Petty, Jr. | 211/46 |

*Primary Examiner*—Alvin C. Chin-Shue

*Assistant Examiner*—Sarah A. Lechok

*Attorney, Agent, or Firm*—Leo Gregory

[57] ABSTRACT

A self locking file folder suspension hanger made up of two u-shaped end members supporting a pair of transversely spaced horizontal suspension members, the end members having upwardly extending free ends having doubled over end portions with the upper closed end portion being doubled over to form a pair of spaced closed upper ends and a depending closed end, the suspension members being disposed through and engaging the undersides of the upper closed ends and a cross member at each end underlying the ends of said suspension members, said cross member having angled end portions being disposed to underlie said suspension members in a downwardly angled position and being rotated axially through 180° to have its angled ends bear up against the suspension members to engage and selflock the same in a pressure action against the overlying upper closed ends.

2 Claims, 3 Drawing Sheets 5
16b
5
16
12d
12k
14
16a 15
12g
12b
16

15
12g
16
12f 5
16b
6
12d
16'
12k
16a

SELF LOCKING FOLDER HANGER STRUCTURE

BACKGROUND OF THE INVENTION

1. Field of Invention

This invention relates to a self locking file folder suspension hangers.

2. Description of the Previous Art

File drawer suspension file folder holders or hangers are in common use and are very competitive in the marketplace.

Basically they consist of end members supporting horizontal side or suspension members. There are various ways of securing the end portions of the suspension members to the supporting end members and commonly used means are tapping the adjacent ends and securing the same as with screws, thumbscrews or clamps. These are relatively costly items of manufacture and assembly. A small reduction in cost of manufacture and/or of assembly provides a significant advantage in price in the marketplace.

SUMMARY OF THE INVENTION

It is the purpose of the invention herein to provide a suspension holder or hanger for file folders which provides a significant competitive advantage in cost of manufacture and in the cost of assembly.

The device herein requires no threading of adjacent parts for the use of screws and requires no added clamping members in assembly.

The end support members are doubled over and again doubled over to form two overhead closed loop ends and a depending transversely closed loop end portion whereby horizontal suspension members are positioned to underlie the upper closed loop ends and a cross bar member has end portions underlying the suspension members at each support end member but resting upon the depending loop end portions. The ends of the cross members are angled and are positioned with ends angled downwardly resting upon the depending closed loop end portions. When thus positioned underlying the horizontal suspension members, the cross members are then rotated axially 180° causing the angled end portions to bear against their underlying support and in a cam action bear up against and elevate the suspension members pressing and wedging them in a self-locked position against the overhead loop ends.

Hence this results in a relatively simplified manufacture and a simplified assembly.

BRIEF DESCRIPTION OF THE DRAWINGS

FIG. 1 is a view in perspective with a portion broken away;

FIG. 1A is a detail showing the formation of a partial loop;

FIG. 1B is a detail showing the formation of the remainder of the loop of FIG. 1A;

DESCRIPTION OF A PREFERRED EMBODIMENT

Figure 2:
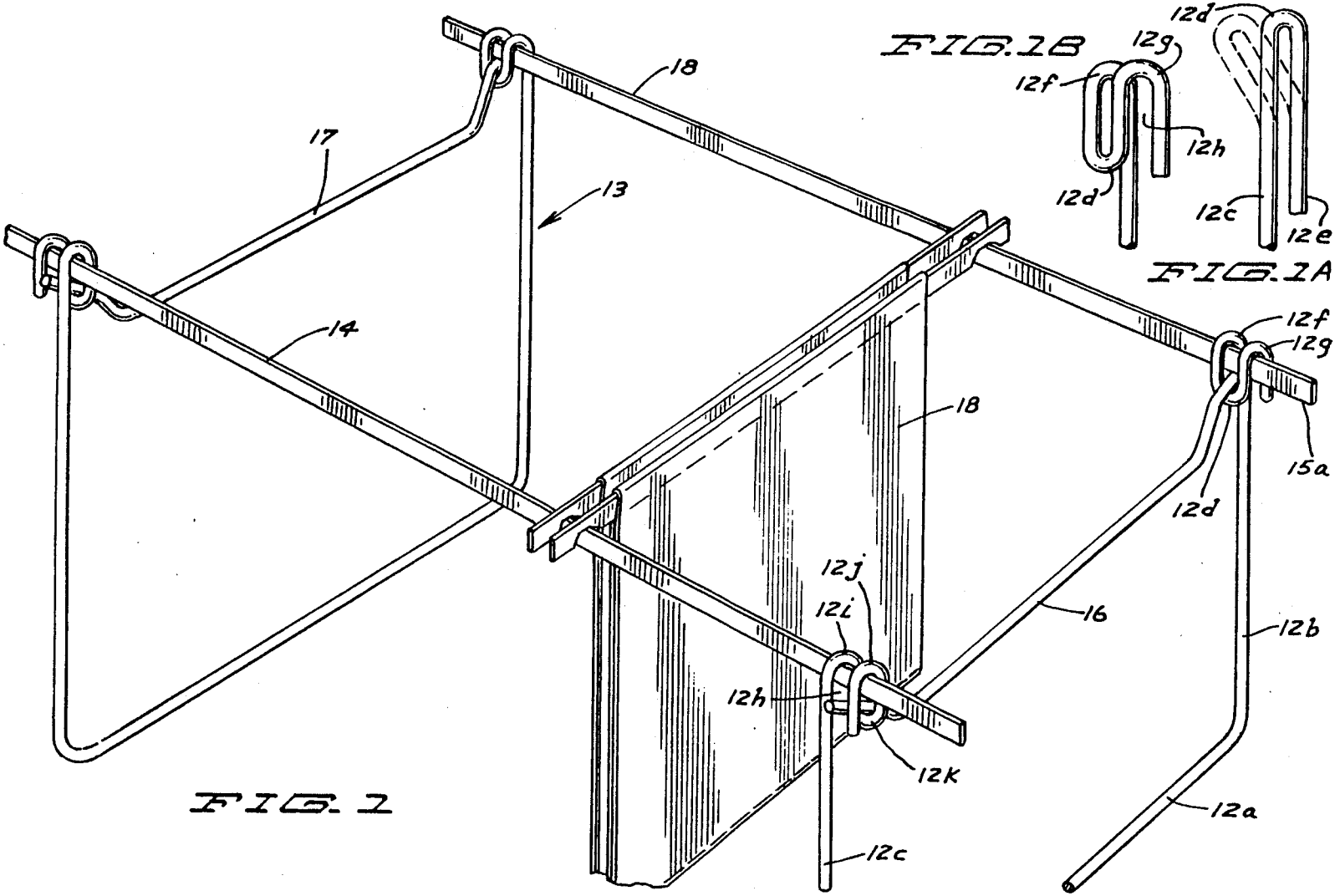
FIG. 2 is a view in front elevation showing a file drawer in vertical cross section.
Figure 2:
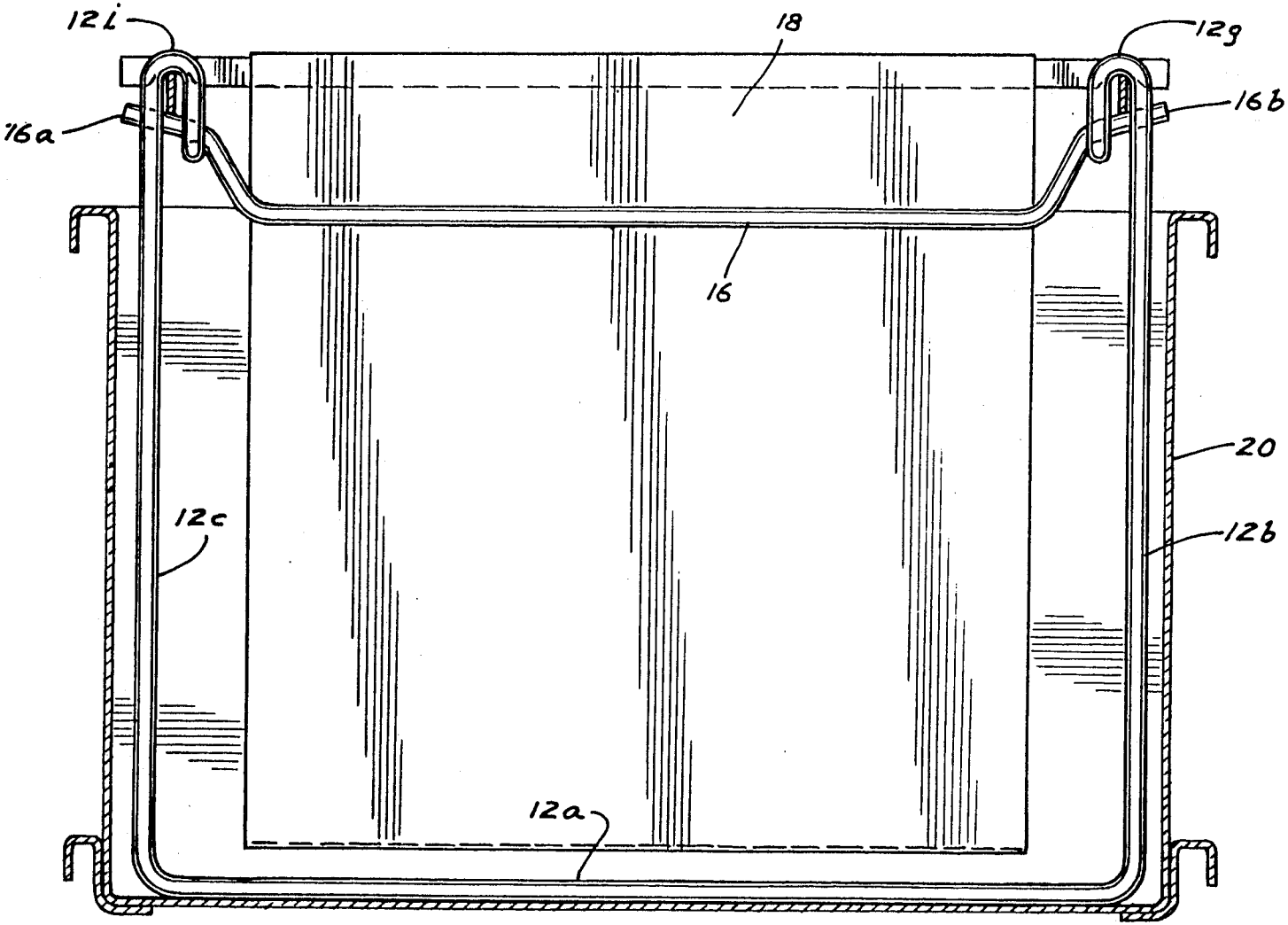

Referring to the drawings and more particularly to FIG. 1, a file drawer file folder suspension hanger 19 is shown consisting of u-shaped self standing rod-like end support members 12 and 13 which are shown in arrangement with horizontal side suspension members 14 and 15 with self-locking cross members 16 and 17, all to be further described. Shown being supported is a file folder holder 18.

The hanger 10 is generally located in a file drawer as in drawer 20 as indicated in FIG. 2 wherein a view of the file drawer is shown in cross section.

The end supporting members may be made conveniently of a heavy gauge galvanized steel wire such as 187 gauge. The suspension members 14 and 15 may be readily made of a suitable flat sheet metal.

File drawers are fairly standard in size and the hanger structure herein will be of a frame size to nicely fit therein.

The support member 12 will be described as representing both end members 12 and 13. The member 12 is formed in a bending operation providing a bottom cross member **12*a* and upstanding side members 12*b* and 12*c*. The member 13** will be labeled in a corresponding manner.

Said side members 12 and 13 respectively have upper end portions which are mirror images of one another.

With references to FIGS. 1A and 1B, in forming the upper end portions 12 and 13, with particular reference to the member 12 and its side **12*b*, the upper end of the side member 12*b* is doubled over for approximately two inches forming a top closed end loop 12*d* having a depending leg 12*e*. Then the doubled over portion is again doubled over or redoubled having the top loop end 12*d* depending downwardly, and having the two top closed end loops 12*f* and 12*g* forming thereunder a channel 12*h*. In like manner the upstanding leg 12*c* has top loops 12*i* and 12*j* and a depending loop 12*k* with a channel 121**.

The end member 13 is formed in a like manner and its further description is not required.

The horizontal members 14 and 15 have their forward end portions **14*a* and 15*a* disposed into and through the channels 12*h* and 121**.

Figures 3, 4, 5, 6:
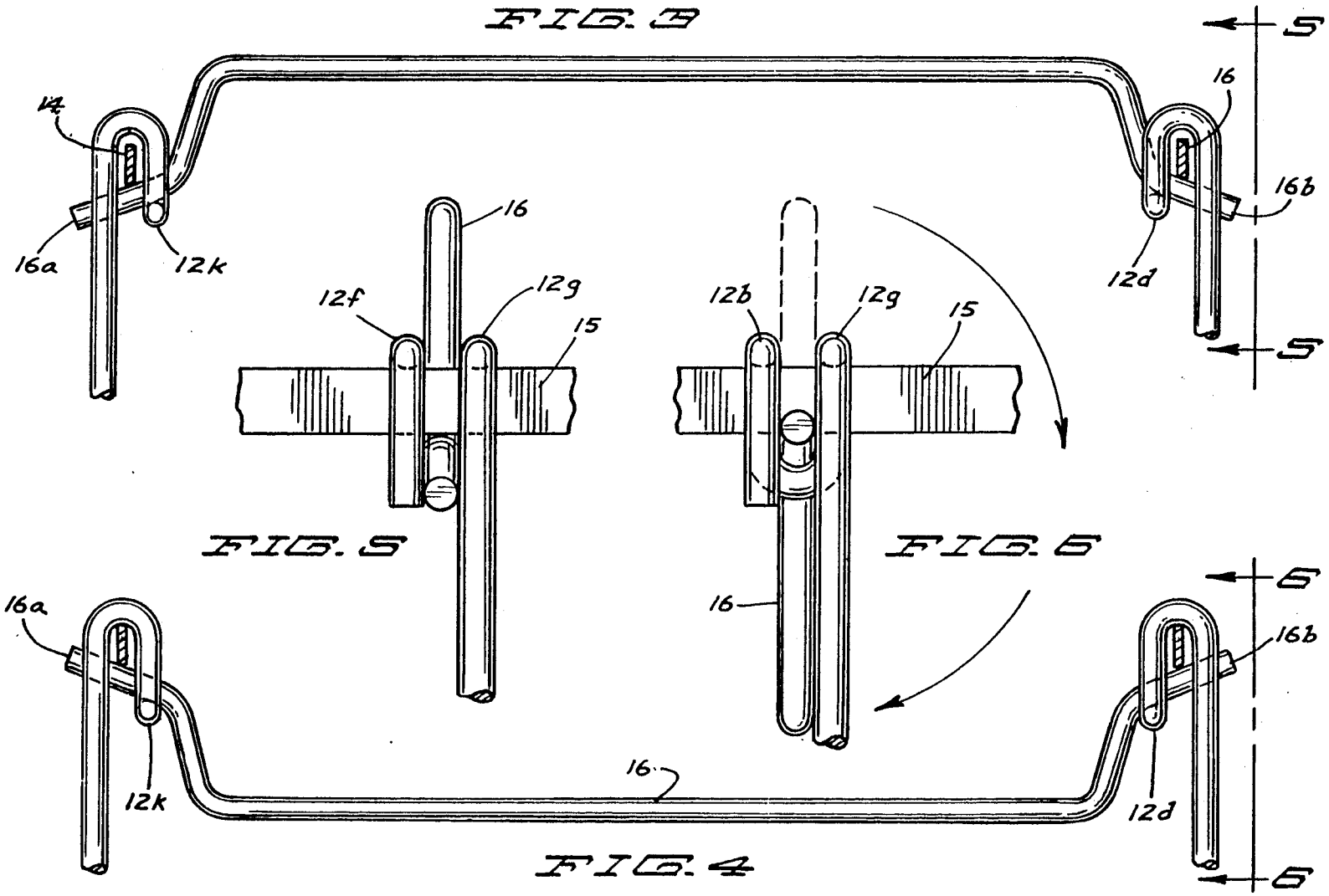
FIG. 3 is a broken view in front elevation showing an unlocked position.
FIG. 4 is a view similar to FIG. 3 showing a locked position.
FIG. 5 is a broken view in end elevation taken on line 5—5 of FIG. 3.
FIG. 6 is a view in end elevation taken on line 6—6 of FIG. 4 as indicated showing a cammed locked position 180° from that of FIG. 5.

Now referring to the cross member 16 and describing it as representative of the cross member 17, it has angled end portions **16*a* and 16*b* and as shown in FIG. 3, the angled ends are turned downwardly and are supported on the depending loop ends 12*d* and 12*k* and thus underlying the adjacent end portions of the suspension members 14 and 15**.

It can be seen in FIG. 3 that the suspension members are not locked into position. Refer now to FIG. 4. Here the cross member 16 has been rotated 180° into a reverse vertical position and depends downwardly at its central cross portion but its angled end portions **16*a* and 16*b* are angled upwardly bearing against the adjacent downward loops 12*d* and 12*k* and thus elevating the adjacent end portions of the suspension members to bear against the upper closed loop ends 12*f* and 12*g*** self-locking them in operating position.

Thus here with a very simple 180° rotation of the cross member 16, the suspension members are in a self-locking operating position with no appreciable time required for the locking operation. Further there is no requirement for separate clamps to be applied or for the engaging end portions to be tapped and screwed together requiring both manufacturing cost and assembling cost.

The invention herein achieves a very remarkable competitive cost advantage which is very significant in establishing a profitable competitive price.

What is claimed is:

1. A file drawer file folder suspension hanger, having in combination, a pair of longitudinally spaced upstanding end support members, said support members each including upstanding side members, a pair of transversely spaced longitudinally disposed suspension frame members, means in connection with each of said upstanding side members securing said suspension members, said means comprising an upper end of each of said upstanding side members being doubled over forming an upper closed loop end, said doubled upstanding end portion being redoubled forming a pair of longitudinally spaced closed upper end loop portions, said first mentioned closed end loop being doubled over into a depending position, said redoubled upper end portion having a channel formed therein, an adjacent end of a suspension member being disposed into said channel, a transverse member being disposed between the side members of each of said support members, the end portions of said transverse members being angled, said transverse members respectively with their ends angled downwardly being disposed through said upper end loops of said end support members overlying said depending loop ends therein and underlying said adjacent end portions of said suspension members, whereby said transverse member is rotated into a reverse vertical position causing said angled end portions thereof to bear upwardly against the adjacent end portions of said suspension members and locking the same in position by pressure thereof against said closed upper end loop portions.

2. A file drawer file folder suspension hanger, having in combination a pair of longitudinally spaced upstanding end support members, said support members each including upstanding side members, a pair of transversely spaced longitudinally disposed suspension frame members, end portions of said suspension members respectively engaging adjacent upper end portions of said side members, said upper end portions being preformed to have a pair of closed end upward extending loops and a closed end depending loop, said upward extending loops respectively being in alignment with said suspension members and forming channels to receive said suspension members therein, a transverse member being disposed between said side members of each of said support members underlying said suspension members and overlying said depending loops, said transverse members being particularly adapted in being rotated axially into an operating position to bear against said suspension members and pressing the same into a locking engagement with said closed ends of said upper extending loops.

* * * * *